US006061874A

United States Patent [19]

Tatara

[11] Patent Number: 6,061,874

[45] Date of Patent: May 16, 2000

[54] LIGHTWEIGHT PIANO HINGE

[76] Inventor: Stanley R. Tatara, 4911 Schutt Rd., Akron, N.Y. 14001

[21] Appl. No.: 09/178,794

[22] Filed: Oct. 26, 1998

[51] Int. Cl.[7] ..... E05F 1/08

[52] U.S. Cl. ..... 16/285; 16/304; 16/308

[58] Field of Search ..... 16/285, 280, 234, 16/263, 264, 256, 304, 307, 308, 386, 381, 50

[56] References Cited

U.S. PATENT DOCUMENTS

| | | | |
|---|---|---|---|
| 401,978 | 4/1889 | Spruce et al. | 16/304 |
| 2,780,830 | 2/1957 | Kammerer, Jr. | 16/380 |
| 4,073,037 | 2/1978 | Curry et al. | 16/304 |
| 4,351,085 | 9/1982 | Suska | 16/304 |
| 4,583,262 | 4/1986 | Werner | 16/300 |
| 4,843,681 | 7/1989 | Mannato | 16/304 |
| 5,930,867 | 8/1999 | Grzeslowiak | 16/381 |

FOREIGN PATENT DOCUMENTS

| | | | |
|---|---|---|---|
| 93/03249 | 2/1993 | WIPO | 16/304 |

*Primary Examiner*—Chuck Y. Mah

[57] ABSTRACT

A lightweight piano-type hinge is comprised of a pair of conventional leafs with knuckles which are in mating meshing relation. The hinge employs a unique hinge pine which comprises a pair of different length hinge pins with an attached coil spring between them for resisting relative rotation of the leafs to spring load the hinge. A pair of large headed machine screw are at each end of the leafs to threadably engage the hinge pins which are selectively secured to the two leafs.

10 Claims, 1 Drawing Sheet

LIGHTWEIGHT PIANO HINGE

BACKGROUND OF THE INVENTION

The invention relates to hinges, especially piano type hinges which are spring loaded and used in lightweight applications, such as on small lightweight metal, plastic or wood doors. Such hinges are usually made of plastic, but can be made of light gage metal, such as aluminum, steel or brass.

It is known to use a highly visible, exteriorly mounted coil spring between the two leafs of a piano hinge to spring load the hinge. Moreover, U.S. Pat. No. 4,823432 discloses a piano hinge with a split hinge pin that employs a concealed, flat piece of spring metal, between adjacent ends of the split hinge pin, to spring load the piano hinge.

The invention is designed to produce a lightweight hinge which is economical to manufacture and repair.

DESCRIPTION OF THE DRAWINGS

The following description of the invention will be better understood by having reference to the accompanying drawing, wherein.

DETAILED DESCRIPTION OF THE DRAWINGS

Figure 1:
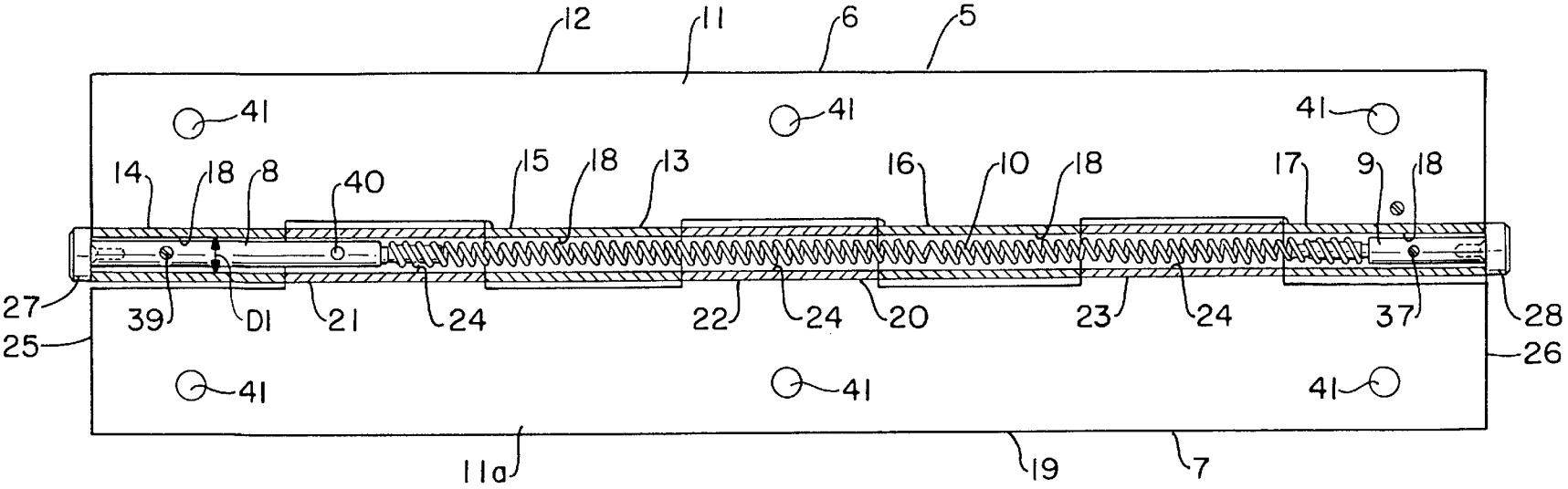
FIG. 1 is a plan view of a lightweight piano hinge which is made in accordance with the invention, and has portions of the knuckles of the leafs removed to better illustrate and understand the invention.
Figure 2:
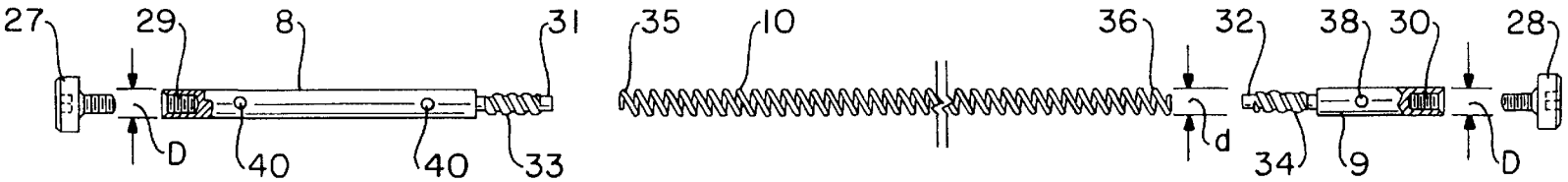
FIG. 2 is a plan view of a pair of opposing, axially aligned hinge pins and a coil spring for attachment to the hinge pins and opposing leafs of the piano hinge of the invention.

With reference to FIGS. 1 and 2, there is shown a lightweight piano hinge 5 which is composed of any suitable lightweight material, e.g. plastic or thin gage aluminum, brass or steel with a corrosive resistant coating. The hinge is comprised of two conventional leafs 6,7, which are mounted together for relative rotation by a pair of unique, axially aligned hinge pins 8,9, with a coil spring 10 specially attached therebetween, the coil spring 10 coacting between the leafs 6,7, to spring load the piano hinge 5. The two hinge pins 8,9, and attached coil spring 10 act, in effect, like a single, elongated hinge pin about which the leafs 6,7, rotate. For purposes of explanation and claiming, the first leaf 6 of the above identified leafs 6,7, is assumed to be attached to a fixed member and, therefore, fixed or stationary, and the second leaf 7 of the above identified leafs 6,7, is assumed to be attached to a rotating member and, therefore, rotatable.

The fixed hinge leaf 6 is comprised of a flat, rectangular section 11 which has a pair of parallel, longitudinal marginal edges 12,13. A plurality of longitudinally spaced and axially aligned, hollow cylindrical knuckles 14–17 are disposed at one of the marginal edges 12,13, of the flat, rectangular section 11 of the fixed hinge leaf 6, e.g. marginal edge 13. The knuckles 14–17 have similar, axially aligned bores 18.

The rotary hinge leaf 7, likewise, has a flat rectangular section 11*a* with a pair of opposing marginal edges 19,20. A plurality of longitudinally spaced and axially aligned and similarly oriented, hollow cylindrical knuckles 21–23 are located along one of the pair of opposing marginal edges 19,20, of the rotary hinge leaf 7, e.g. marginal edge 20. The knuckles 21–23 of the rotary hinge leaf 7 have similar, axially aligned bores 24, and are designed for mating and meshing engagement with the knuckles 14–17 of the fixed hinge leaf 6, such that the knuckles and bores therein are axially aligned when the two leafs 6,7, are pinned or mounted together to form the piano hinge 5.

The unique, longer hinge pin 8 is designed to axially span about two adjacent knuckles 14,21, of the leafs 6,7, at one end 25 of the piano hinge 5, whereas the other unique hinge pin 9 is made substantially shorter to span only one knuckle 17 of the leaf 6 at the other, opposing end 26 of the piano hinge 5. It can be appreciated by those skilled in the art that such differently sized hinge pins 8,9, can be used in both the shortest and longest piano hinges 5 contemplated by the invention. This is not to say that such hinge pins 8,9, can't be custom made, for example, to be longer and of the same length for a particular size piano hinge 5, if the quantity involved warrants such production.

Large headed machine screws 27,28. threadably engage the exteriorly outermost adjacent ends 29,30, respectively, of the longer and shorter hinge pins 8,9, to keep them in position at the ends 25,26, of the piano hinge 5 and keep them from moving further interiorly of the aligned bores 18,24, under any tension from the coil spring 10. The screws 27,28, can also be used to adjust tension in the coil spring 10.

The innermost ends 31,32, of the hinge pins 8,9, closest the coil spring 10, are provided with similar, but opposing spiral grooves 33,34, for matingly receiving adjacent ends 35,36, of the coil spring 10 which, when seated in the grooves 33,34, has the same outside diameter d, throughout its length, which is substantially the same as the outside diameter D of the hinge pins 8,9, which outside diameter D of the hinge pins 8,9, is slightly smaller than the inside diameter D1 of the bores 18,24.

The knuckle 17 of the first leaf 6, adjacent the end 26 of the hinge 5, is provided with a threaded opening (not shown) for threadably receiving a set screw 37 which is designed to engage an aligned opening 38 in the adjacent, shorter hinge pin 9 and hold it firmly within the knuckle 17 of the first leaf 6 and prevent any movement thereof relative thereto.

The knuckle 14 of the first leaf 6 at the opposing end 25 of the hinge 5 and the adjacent knuckle 21 of the second leaf 7 are each provided with a similar, threaded opening (not shown) for selectively, threadably receiving a set screw 39 which is designed to selectively engage similar, aligned openings 40 which are axially spaced along the longitudinal axis of the adjacent, longer hinge pin 8. In this case, the set screw 29 is received in the aligned opening of the knuckle 21 of the second hinge leaf 7 to hold the longer hinge pin 18 firmly to the second leaf 7 and prevent any movement thereof relative thereto. Such action will cause the hinge to be spring loaded by the coil spring 10. That is, the coil spring 10 will act to resist relative rotation of the first and second leafs 6,7. It can be appreciated that, in some cases, the set screw 39 will be positioned to hold the longer hinge pin 8 firmly in the knuckle 14 of the first leaf 6, when the shorter hinge pin 9 is held firmly in a knuckle of the second leaf 7 to spring load the hinge 5.

The hinge leafs 6,7, are conventionally provided with a number of similarly sized holes 41 for receipt of screws which are used to fasten the leafs 6,7, to adjacent members, such as a rotatable door and a fixed jamb.

A typical 10 inch long piano hinge, similar to that shown in FIG. 1, would be provided with a longer hinge pin 8 which is 3.625 inches long, a shorter hinge pin 9 which is 1.881 inches long, a coil spring 10 which is 4.625 inches long, and two threaded end screw which are each 0.530 inches long overall with an enlarged head that has a thickness of 0.218 inches. The spirally grooved ends of the two hinge pins 8,9, are each 0.700 inches long. The two hinge pins 8,9, have a 0.185 inch outside diameter, and the coil spring 10 has an outside diameter of 0.245 inches and an inside diameter of 0.135 inches.

Thus, there has been described a unique device for spring loading a lightweight piano hinge. It is a simple matter to cut a conventional, off the shelf, coil spring to fit between the hinge pins and then attach it to the spiral grooves in the adjacent ends of the hinge pins at the opposing ends of the hinge.

What is claimed is:

1. A spring loaded piano hinge, comprising:

a) a pair of leafs having the same length measured longitudinally thereof, each of the leafs having a plurality of axially aligned and longitudinally spaced hollow knuckles, the hollow knuckles of the leafs being in mating and meshing relation and forming a bore which is coextensive with the leafs, when the leafs are joined together to form the hinge, the joined leafs having a pair of longitudinally spaced opposing ends;

b) a rigid hinge pin disposed in the bore at each of the opposing ends of the joined leafs to form a pair of longitudinally spaced hinge pins which have a pair of interiorly spaced confronting ends and about which the joined leafs rotate, the hinge pins having the same outside diameter which is less than the inside diameter of the bore, each of the hinge pins having an enlarged head which is bigger than the bore and disposed exteriorly thereof to restrict axial movement of the hinge pins in the bore in directions towards each other, one of the hinge pins being longer, measured axially, than the other hinge pin which is shorter;

c) a coil spring disposed in the bore between the confronting ends of the hinge pins and secured thereto, the coil spring, between the confronting ends of the hinge pins, being hollow and free of any rigid reinforcement within coils of the spring, the coil spring having the same outside diameter as the hinge pins and acting as a continuation of the hinge pins between the confronting ends thereof, the coil spring having a pair of longitudinally spaced opposing ends;

d) means for securing the shorter hinge pin to a knuckle of one of the pair of leafs for rotation therewith;

e) means for securing the longer hinge pin to a knuckle of the other of the pair of leafs for rotation therewith;

f) means for securing the opposing ends of the coil spring to the confronting ends of the hinge pins for rotation therewith, such that the coil spring will act as a torsion spring to resist relative rotation of the leafs, thereby spring loading the hinge; and g) means for removably mounting an enlarged head on at least one of the hinge pins to help in the assembly of the hinge and axially tension the coil spring to maintain the attached hinge pins in the bore.

2. The hinge of claim 1, wherein the means for securing the opposing ends of the coil spring to the confronting ends of the hinge pins, includes oppositely disposed, spiral grooves formed in the confronting ends of the hinge pins to matingly receive the opposing ends of the coil spring.

3. The hinge of claim 2, wherein the means for securing the shorter hinge pin to one of the pair of leafs, includes a first set screw threadably engaged in transversely aligned openings in the shorter hinge pin and adjacent knuckle of the said one of the pair of leafs.

4. The hinge of claim 3, wherein the means for securing the longer hinge pin to the other of the pair of leafs, includes a second set screw threadably engaged in transversely aligned openings in the longer hinge pin and adjacent knuckle of said other of the pair of leafs.

5. The hinge of claim 4, wherein the longer hinge pin includes a pair of longitudinally spaced openings for selectively receiving the second set screw.

6. The hinge of claim 5, wherein the leafs are composed of materials selected from the group consisting of plastic, aluminum, brass, bronze, and steel.

7. The hinge of claim 5, wherein the spirally grooved ends of the hinge pins are each at least one-half inches long, measured axially of the hinge pin.

8. The hinge of claim 2, wherein each of the confronting ends of the hinge pins, includes a reduced diameter end portion which has a length, measured axially of the hinge pin, sufficient to accommodate the spiral grooves therein.

9. The hinge of claim 1, wherein the enlarged head mounting means, includes a threaded hole centrally disposed in the at least one hinge pin for threadably receiving a threaded machine screw with an enlarged flat head.

10. The hinge of claim 9, wherein each of the hinge pins are designed to threadably receive a machine screw with an enlarged flat head.

* * * * *